US006701808B2

(12) United States Patent
Hsieh

(10) Patent No.: US 6,701,808 B2
(45) Date of Patent: Mar. 9, 2004

(54) WRENCH CAPABLE OF PREVENTING A SCREWED MEMBER FROM SLIPPING OUT AND HOLDING THE SCREWED MEMBER

(76) Inventor: Chih-Ching Hsieh, No. 361-1, Pei Yang Road, Feng Yuan, Taichung Hsien (TW)

( * ) Notice: Subject to any disclaimer, the term of this patent is extended or adjusted under 35 U.S.C. 154(b) by 113 days.

(21) Appl. No.: 10/067,876

(22) Filed: Feb. 8, 2002

(65) Prior Publication Data

US 2003/0150301 A1 Aug. 14, 2003

(51) Int. Cl.[7] ..... B25B 13/00
(52) U.S. Cl. ..... 81/124.3
(58) Field of Search ..... 81/124.3, 125, 81/176.2, 13

(56) References Cited

U.S. PATENT DOCUMENTS 2,320,044 A * 5/1943 Merriman ..... 81/125
2,801,561 A * 8/1957 Bonner ..... 81/124.3
2,805,594 A * 9/1957 Fogel ..... 81/125
2,806,706 A * 9/1957 Fitch ..... 279/79
2,880,637 A * 4/1959 Koenig ..... 81/10
3,347,293 A * 10/1967 Clark ..... 81/438
5,295,422 A * 3/1994 Chow ..... 81/124.3
5,791,848 A * 8/1998 Lanham ..... 411/373
6,332,382 B1 * 12/2001 Anderson et al. ..... 81/438

* cited by examiner

*Primary Examiner*—Lee D. Wilson
*Assistant Examiner*—David B. Thomas
(74) *Attorney, Agent, or Firm*—Alan Kamrath

(57) ABSTRACT

Wrench capable of preventing a screwed member from slipping out and holding the screwed member. One end of the wrench has a head section formed with a polygonal socket. Multiple teeth are formed on the circumference of the socket for engaging with the screwed member. An annular groove is formed in the head section and a resiliently stretchable retainer ring is disposed in the annular groove. An inner edge of the retainer ring protrudes into the socket to form a stopper section. When the socket is fitted onto the screwed member, the retainer ring serves to stop the screwed member from slipping out of the socket. Also, the retainer ring can be resiliently outward stretched from the annular groove to make the screwed member fitted into the retainer ring and held thereby.

12 Claims, 11 Drawing Sheets

WRENCH CAPABLE OF PREVENTING A SCREWED MEMBER FROM SLIPPING OUT AND HOLDING THE SCREWED MEMBER

BACKGROUND OF THE INVENTION

The present invention is related to a hand tool, and more particularly to a wrench having a box end. When the box end of the wrench is fitted onto a hexagonal screwed member, the box end is able to stop the screwed member from slipping from the wrench. Furthermore, the box end is able to hold the screwed member.

A conventional wrench has a box end formed with a polygonal socket for fitting onto and driving a screwed member such as a nut or a bolt. The socket passes through the box end so that when the box end of the wrench is fitted onto the screwed member, the screwed member is likely to slip out of the socket. This results in inconvenience in operation. Many kinds of improved wrenches with stopping effect have been developed to prevent the screwed member from slipping from the wrench.

FIG. 1 shows a conventional wrench 10 having a polygonal socket 11. A projecting section 12 is formed on the top edge of each inner corner. When the wrench is fitted onto a nut 14, the projecting sections 12 serve to stop the nut as shown in FIG. 2.

FIGS. 3 and 4 show another type of conventional wrench 15 having a head section 16. A ring body 17 is inlaid in the head section 16 and protrudes from the inner circumference into the socket 18 for stopping a nut.

Both the above stopper structures have shortcomings. For example, when the wrench is fitted onto the screwed member, the screwed member is prevented from upward slipping out of the socket. However, when lifting the wrench, the screwed member still will downward slip out of the socket. In other words, the wrench is unable to hold the screwed member in the socket.

SUMMARY OF THE INVENTION

It is therefore a primary object of the present invention to provide a wrench capable of preventing a screwed member from slipping out of the socket of the wrench. Furthermore, the wrench is able to hold the screwed member.

The present invention can be best understood through the following description and accompanying drawings wherein:

DETAILED DESCRIPTION OF THE PREFERRED EMBODIMENTS

Figure 1:
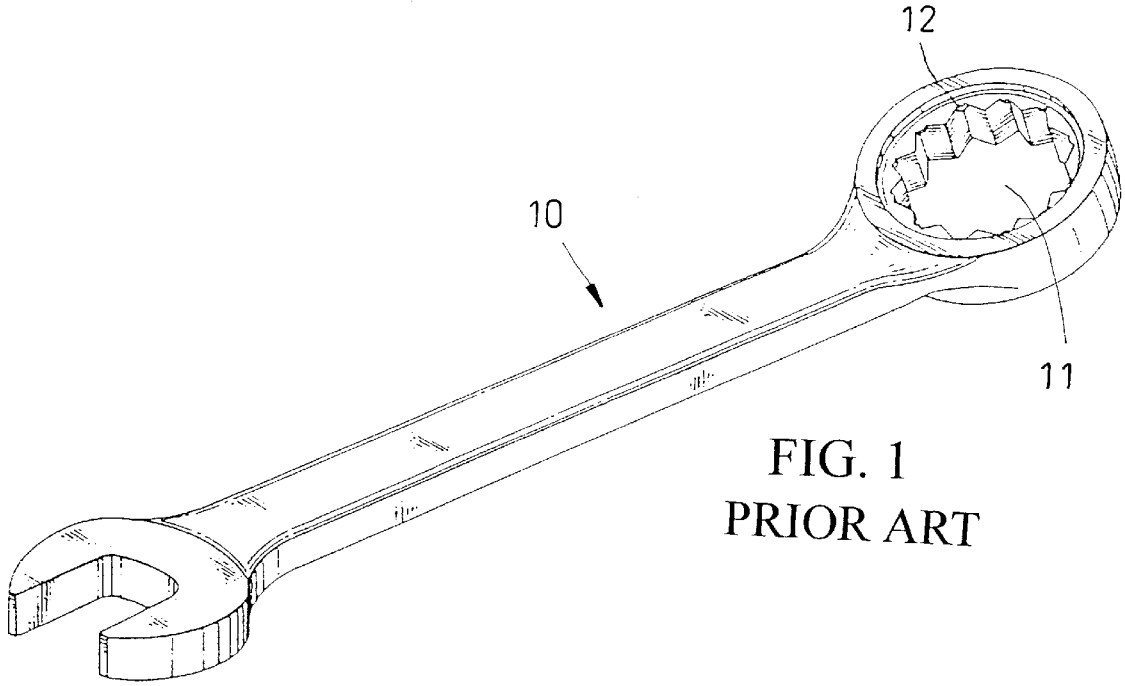
FIG. 1 PRIOR ART
FIG. 1 is a perspective view of a conventional wrench.
Figure 2:
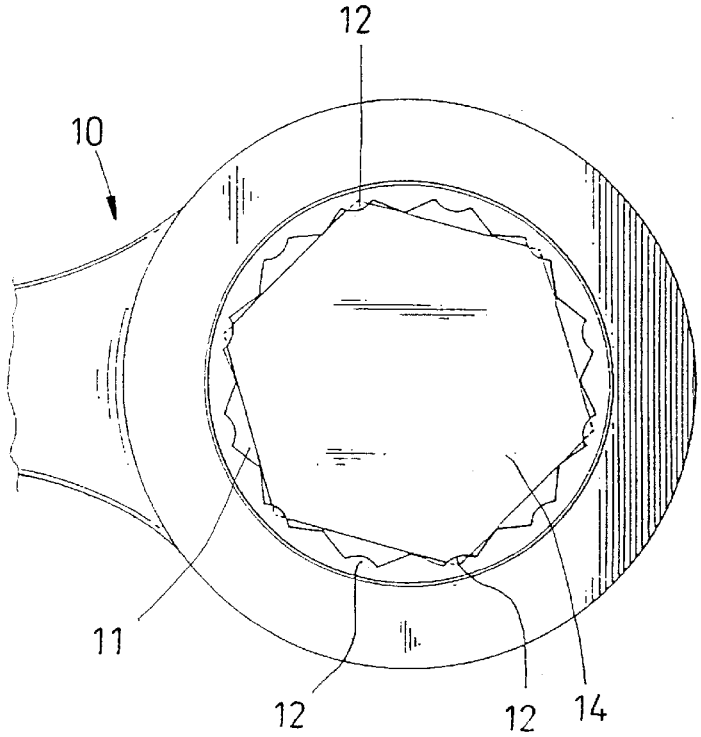
FIG. 2 PRIOR ART
FIG. 2 shows the use of the conventional wrench of FIG. 1.
Figure 3:
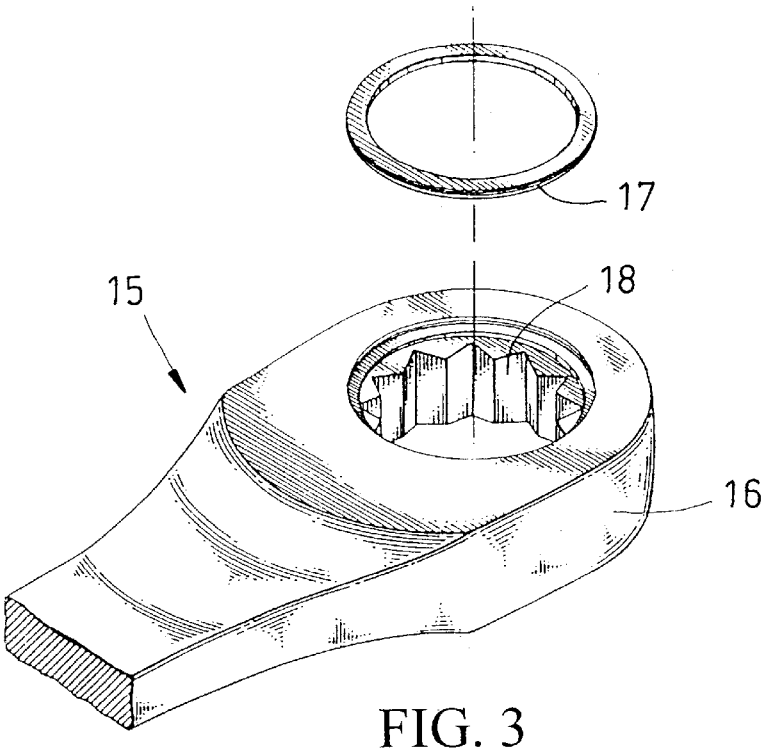
FIG. 3 PRIOR ART
FIG. 3 is a perspective exploded view of another type of conventional wrench.
Figure 4:
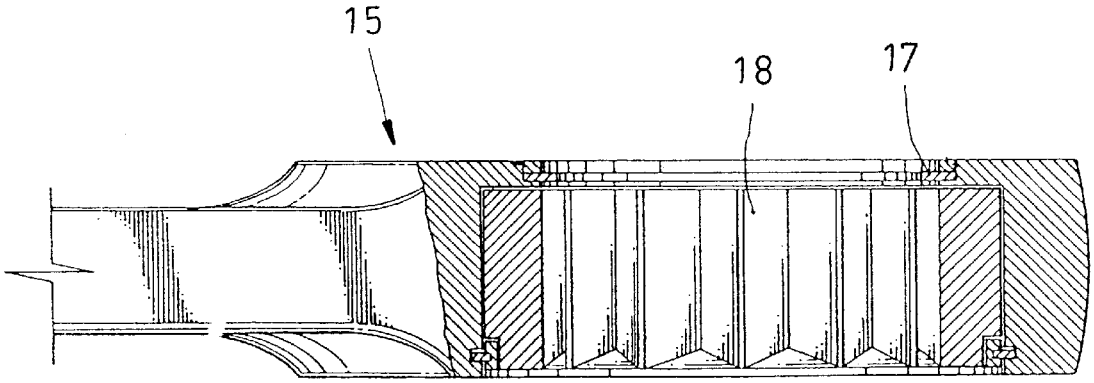
FIG. 4 PRIOR ART
FIG. 4 is a sectional assembled view according to FIG. 3.
Figure 5:
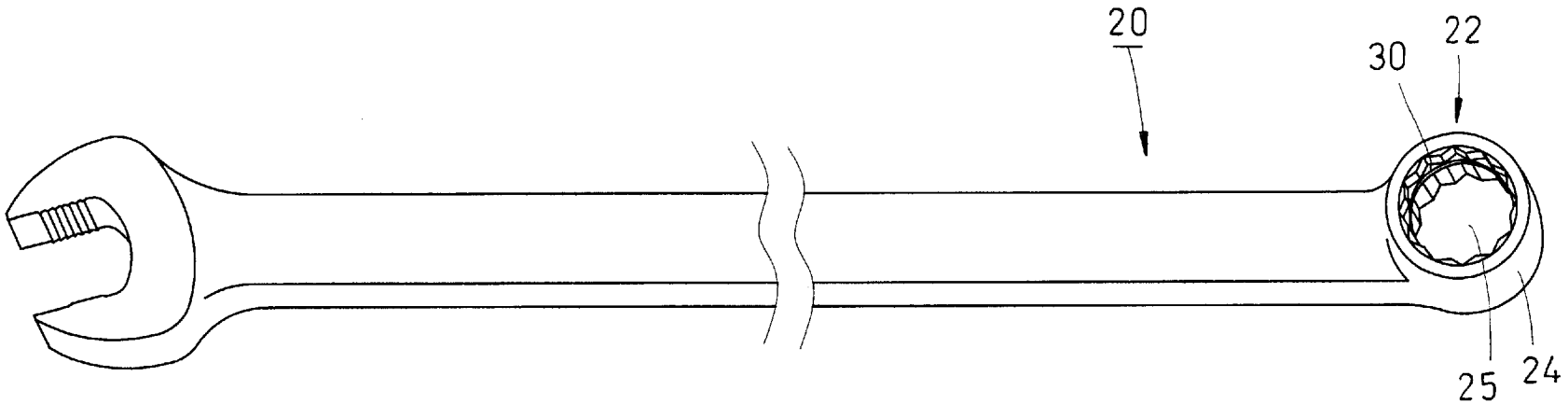
FIG. 5 is a perspective view of a preferred embodiment of the present invention applied to a fixed wrench.
Figure 6:
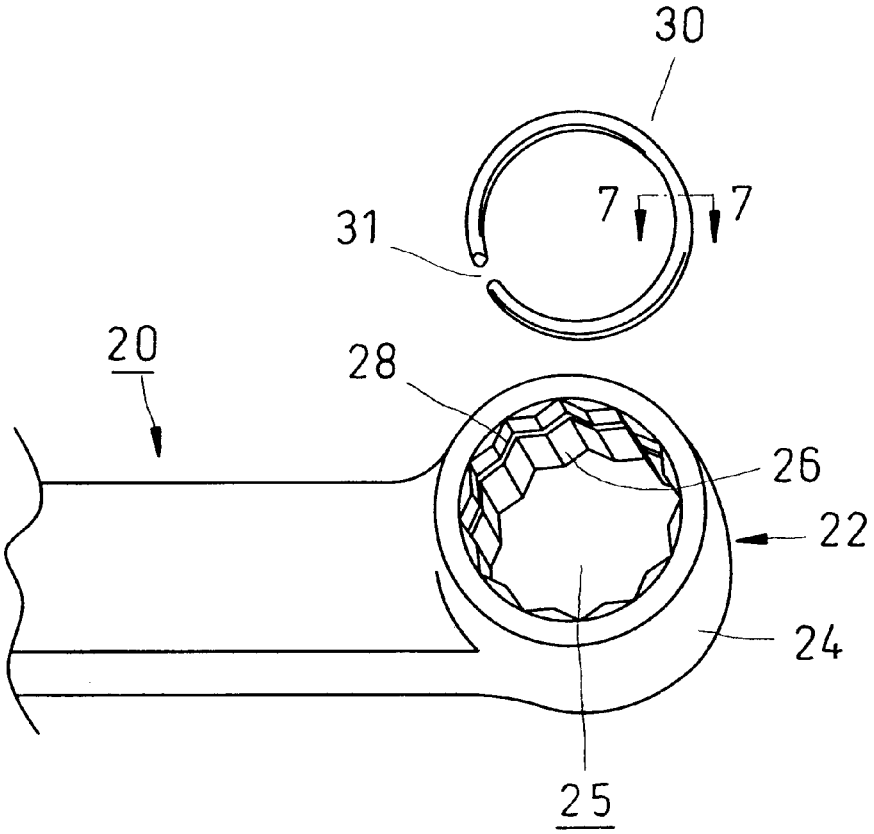
FIG. 6 is a perspective exploded view according to FIG. 5.
Figure 12:
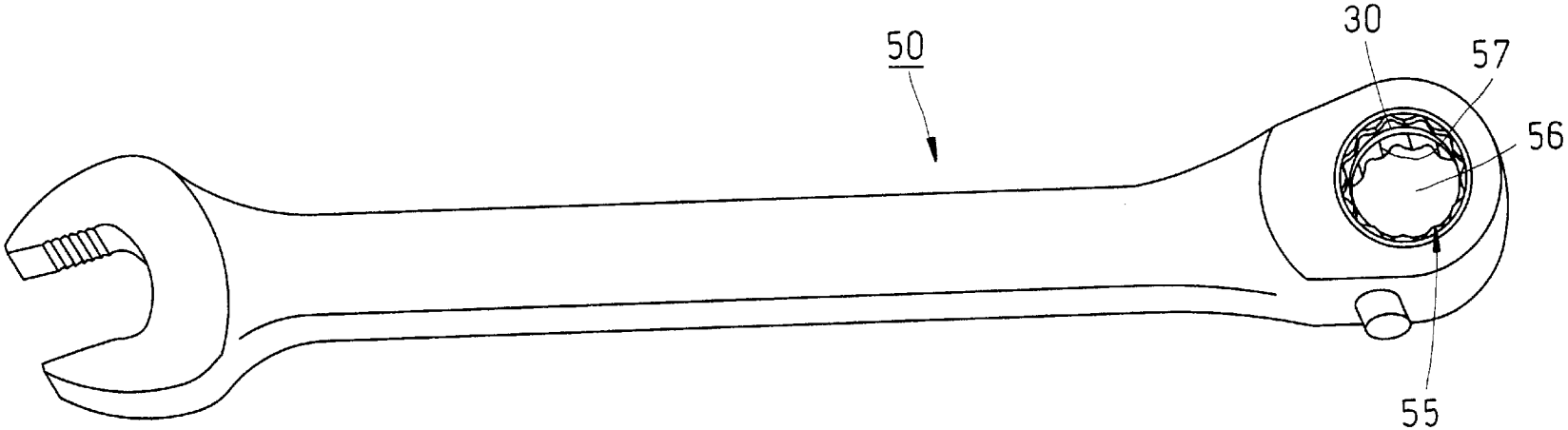
FIG. 12 shows that the retainer ring of FIG. 5 is applied to a ratchet wrench.

The wrench of the present invention can be a fixed wrench 20 as shown in FIGS. 5 and 6 or a ratchet wrench as shown in FIG. 12.

Referring to FIGS. 5 and 6, the wrench 20 has a box end 22. The head section 24 of the box end 22 is formed with a polygonal socket 25 which is generally hexagonal or dodecagonal. The socket 25 has multiple teeth 26. The circumference of the socket 25 is formed with an annular groove 28.

Figure 7:
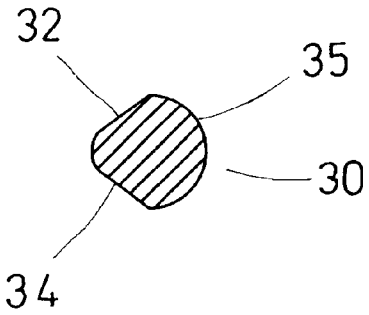
FIG. 7 is a sectional view taken along line 7—7 of FIG. 6.

A retainer ring 30 is inlaid in the annular groove 28. The retainer ring 30 is a resiliently stretchable ring body. In this embodiment, the ring body has a split 31 and can be resiliently stretched. FIG. 7 shows the cross-section of the retainer ring 30. An inner side of the top of the cross-section is formed with an upper slope 32, while an inner side of the bottom thereof is formed with a lower slope 34. The outer side of the cross-section is formed with an arched face 35.

Figure 8:
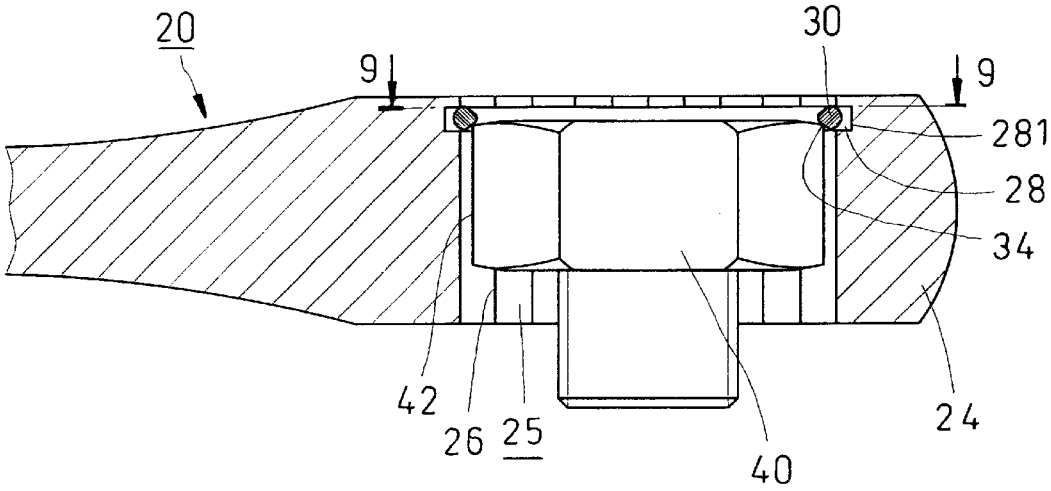
FIG. 8 is a sectional view according to FIG. 5, showing that the wrench is fitted onto a screwed member.

Referring to FIG. 8, in normal state, the retainer ring 30 is positioned in the annular groove 28 in the socket 25. A gap exists between the outer edge of the retainer ring 30 and the inner circumference 281 of the annular groove 28, whereby a space is reserved for the retainer ring 30 to stretch. The inner edge of the retainer ring protrudes into the socket.

Figure 9:
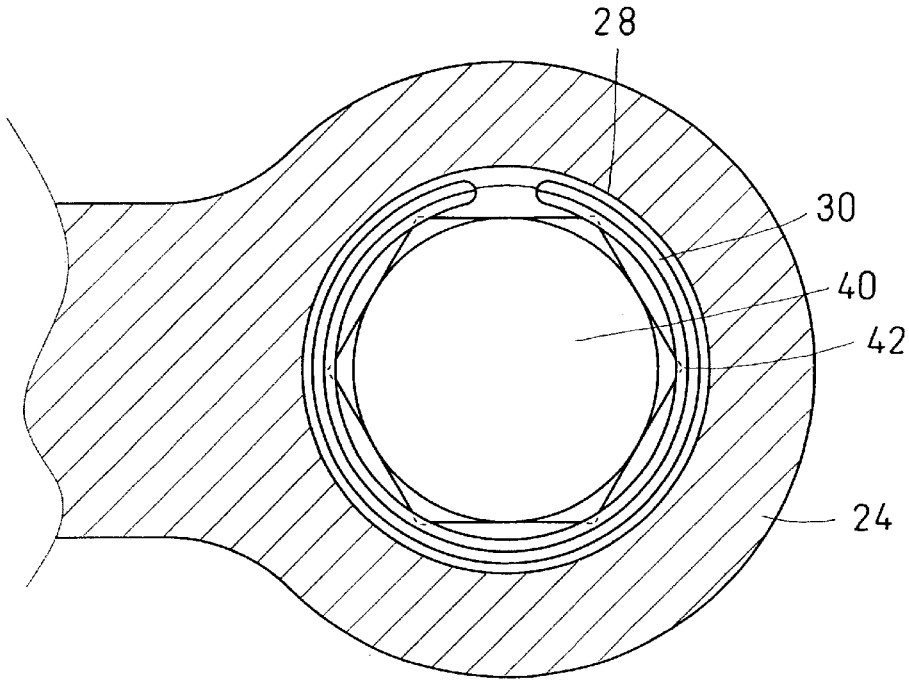
FIG. 9 is a sectional view taken along line 9—9 of FIG. 8.

FIGS. 8 and 9 show a using state of the wrench 20. When the socket 25 of the wrench is fitted onto a screwed member 40, the six corners 42 of top end of the screwed member 40 abut against the lower slope 34 of the retainer ring 30. Therefore, the screwed member is stopped by the retainer ring from upward slipping from the socket.

Figure 10:
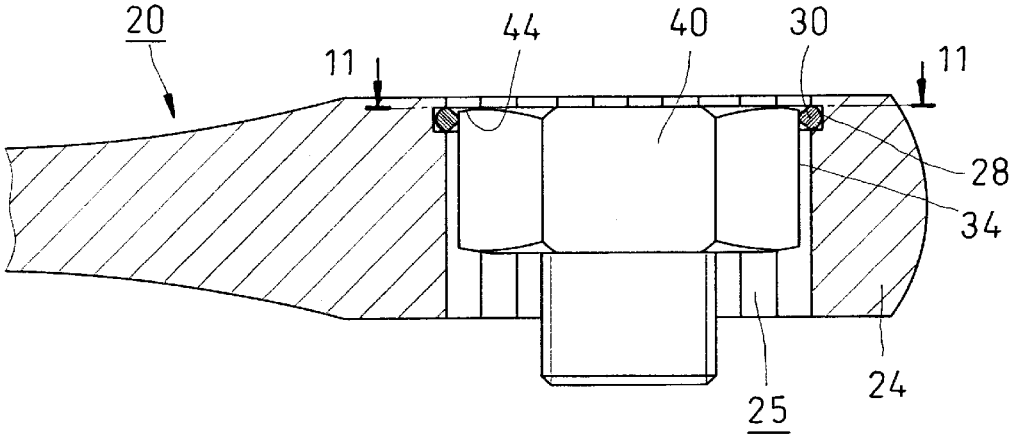
FIG. 10 is a view according to FIG. 8, showing that the screwed member is held in the socket of the wrench.
Figure 11:
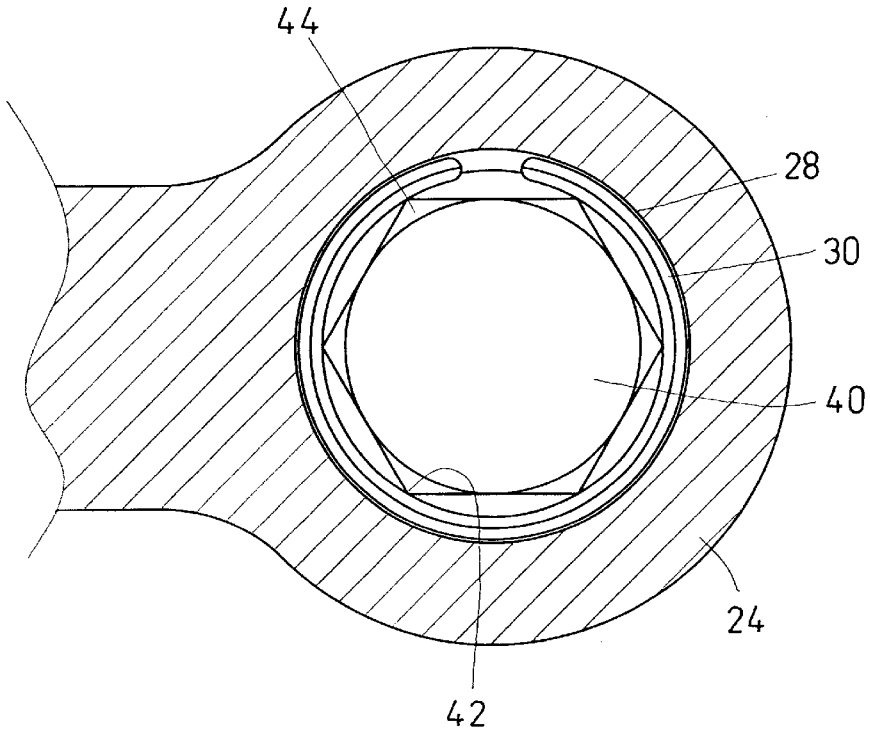
FIG. 11 is a sectional view taken along line 11—11 of FIG. 10.

In operation, as shown in FIGS. 10 and 11, the wrench 20 can be forcedly pressed down. Under such circumstance, the top end of the screwed member 40 presses the lower slope 34 to stretch the retainer ring 30. At this time, the outer circumference of the screwed member can slip into the retainer ring and the six corners 42 are held by the retainer ring. In some operation conditions, this enables a user to more conveniently operate the wrench.

It should be noted that the top end of the screwed member 40 has a tapered face 44 as shown in FIGS. 10 and 11. Therefore, in the case that the retainer ring is free from the lower slope 34, the tapered face 44 of the screwed member can still forcedly stretch the retainer ring.

Figure 13:
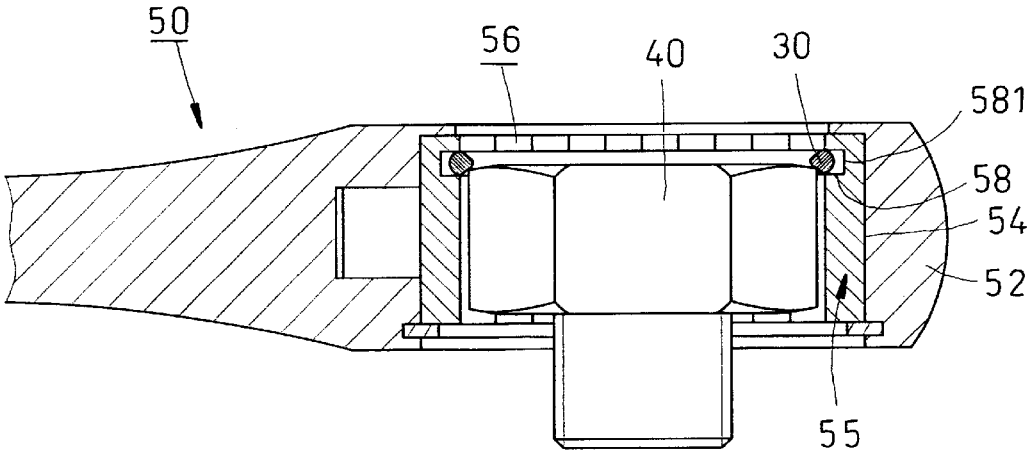
FIG. 13 is a longitudinal sectional view according to FIG. 12.

FIG. 12 shows another embodiment of the present invention which is a ratchet wrench 50. As shown in FIG. 13, a ratchet wheel 55 is disposed in a through hole 54 of the head section 52 of the wrench. The ratchet wheel cooperates with a dog member (not shown) to only one-way rotate within the through hole. The ratchet wheel 55 is formed with a polygonal socket 56. Also, an annular groove 58 is formed in the socket.

The retainer ring 30 is inlaid in the annular groove 58 as shown in FIG. 13. In normal state, a gap exists between the outer edge of the retainer ring 30 and the inner circumference 581 of the annular groove 58, whereby the retainer ring can be resiliently stretched. The inner edge of the retainer ring protrudes into the socket. When the ratchet wrench 50 is fitted onto a screwed member 40, the retainer ring also serves to stop the screwed member. The ratchet wrench can be pressed down to stretch the retainer ring. At this time, the screwed member will slip into the retainer ring and held thereby.

In the fixed wrench of FIG. 5, the teeth 26 are fully formed in the socket 25 with a height between the top and bottom of the head section 24. The annular grooves 28, 58 of FIGS. 5 and 12 are formed in the sockets 25, 56.

Figure 14:
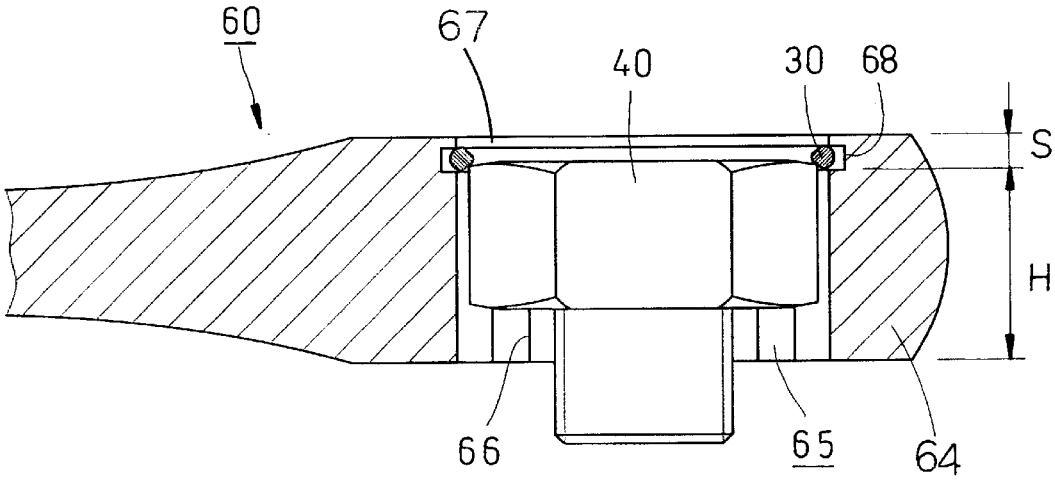
FIG. 14 is a sectional view of another embodiment of the present invention applied to a fixed wrench.

FIG. 14 is a sectional view of still another embodiment of the present invention, which is a fixed wrench 60. The socket 65 of the box end of the wrench has multiple teeth 66. This embodiment is different from the above embodiments in that the teeth 66 have a certain height H. A wall with thickness S free from any tooth is reserved between the top of the teeth and the top of the head section 64 of the wrench. The wall defines an inner hole 67 communicating with the socket 65. An annular groove 68 is formed in the inner hole 67. The retainer ring 30 is inlaid in the annular groove. Also, the inner edge of the retainer ring protrudes into the socket 65 to stop and hold a screwed member 40.

Figure 15:
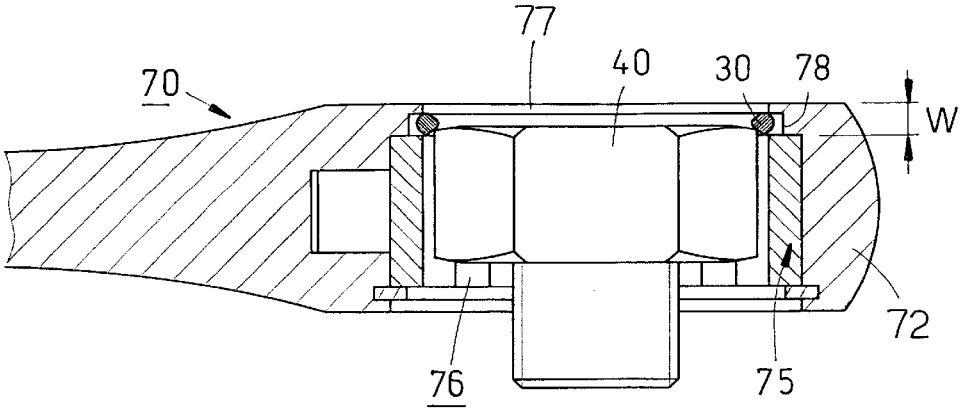
FIG. 15 is a view according to FIG. 14, showing that the present invention is applied to a ratchet wrench.

FIG. 15 is a sectional view of a ratchet wrench 70. A wall with thickness W is reserved between the top of the ratchet wheel 75 mounted in the head section 72 and the top of the head section. The wall defines a tooth-free inner hole 77 communicating with the socket 76 of the ratchet wheel. An annular groove 78 is formed in the inner hole 77. The retainer ring 30 is inlaid in the annular groove 78. Also, the inner edge of the retainer ring protrudes into the socket 76 to stop and hold a screwed member 40.

Figure 16:
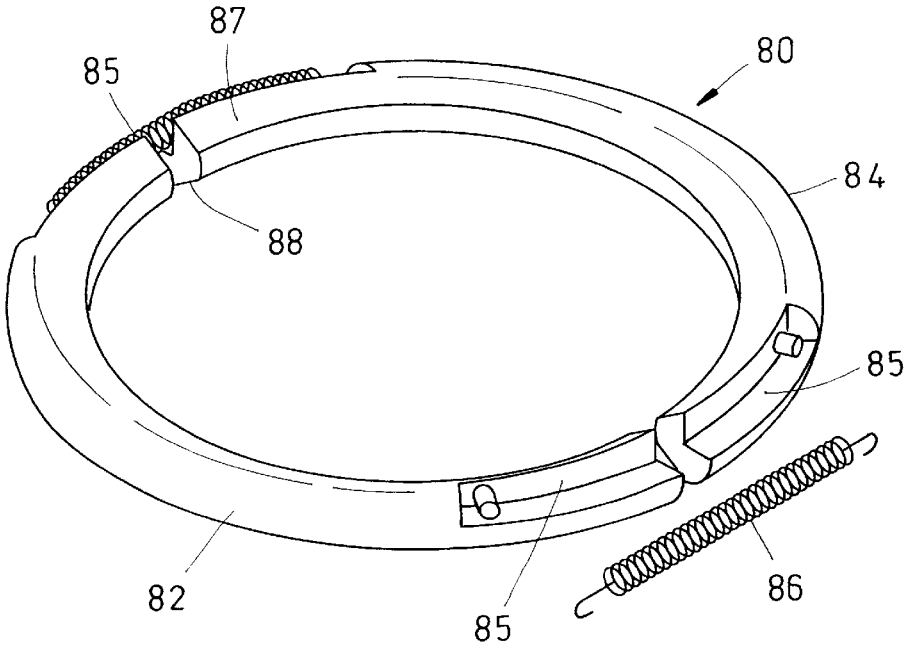
FIG. 16 is a perspective view of another embodiment of the retainer ring of the present invention.
Figure 17:
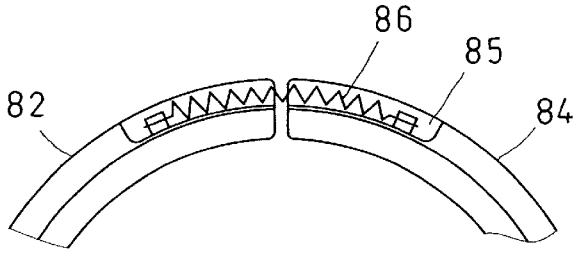
FIG. 17 is a top enlarged view of a part of FIG. 16.

FIG. 16 shows still another embodiment of the retainer ring 80 of the present invention. The retainer ring has two semicircular ring bodies 82, 84 which are oppositely adjoined with each other. Two ends of each ring body are respectively formed with two recesses 85. Two resilient members 86 are respectively disposed in the recesses 85 of the two ring bodies as shown in FIG. 17. Two ends of each resilient member are respectively hooked on the two ring bodies 82, 84, whereby the retainer ring can be resiliently split. The cross-section of the retainer ring also has an upper slope 87 and a lower slope 88.

Figure 18:
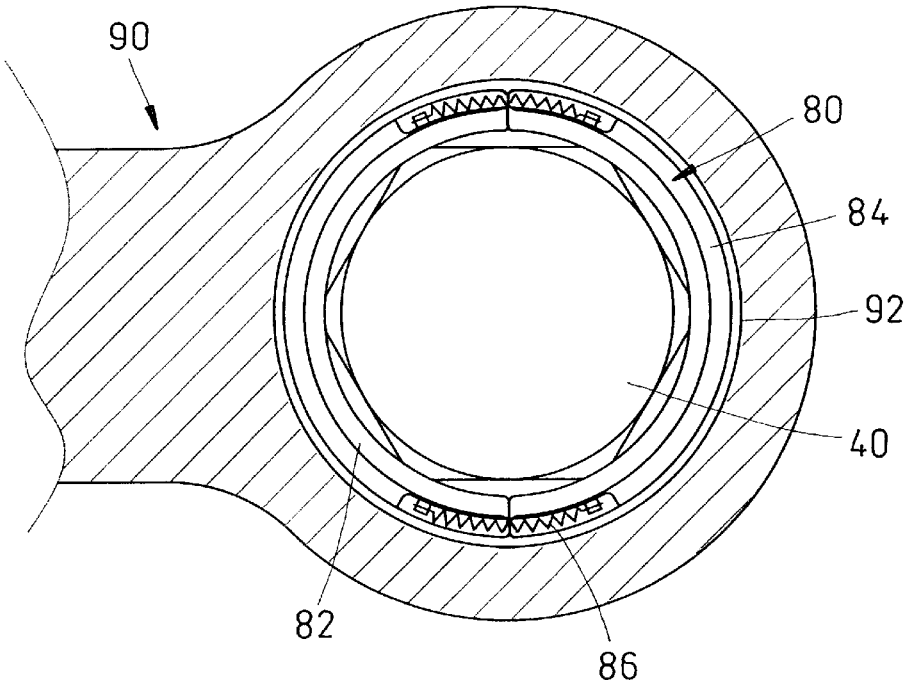
FIGS. 18 and 19 show that the retainer ring of FIG. 16 is mounted in the wrench in an operated state.
Figure 19:
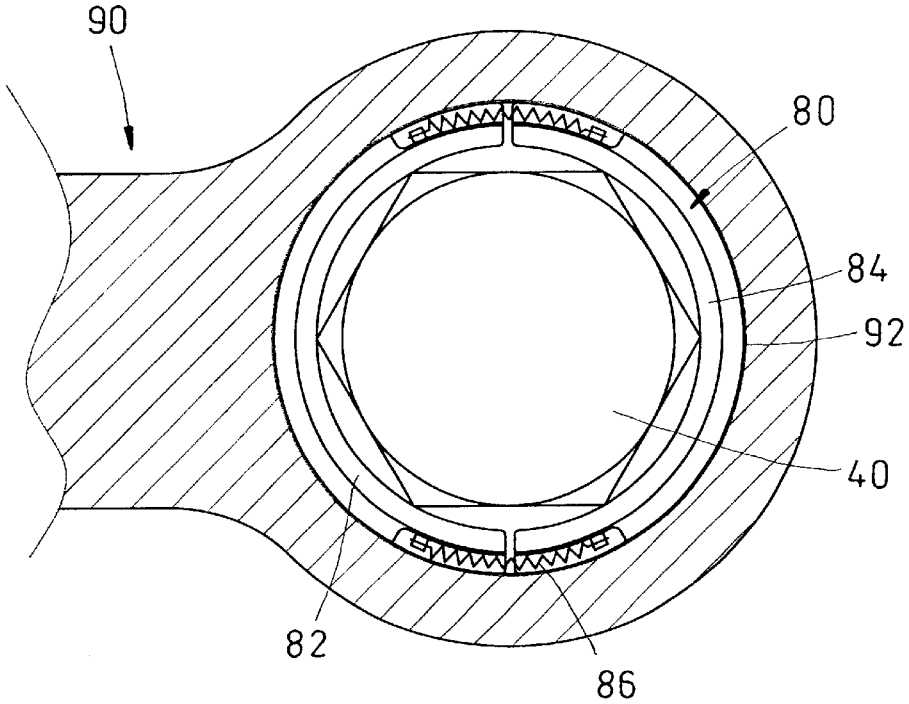

The retainer ring 80 is inlaid in the annular groove 92 of a wrench 90 of the above wrenches. In FIG. 18, the retainer ring is resiliently forcedly closed by the resilient members 86 to stop the screwed member 40. When the wrench is pressed down, the retainer ring is resiliently split to hold the screwed member as shown in FIG. 19.

Figure 20:
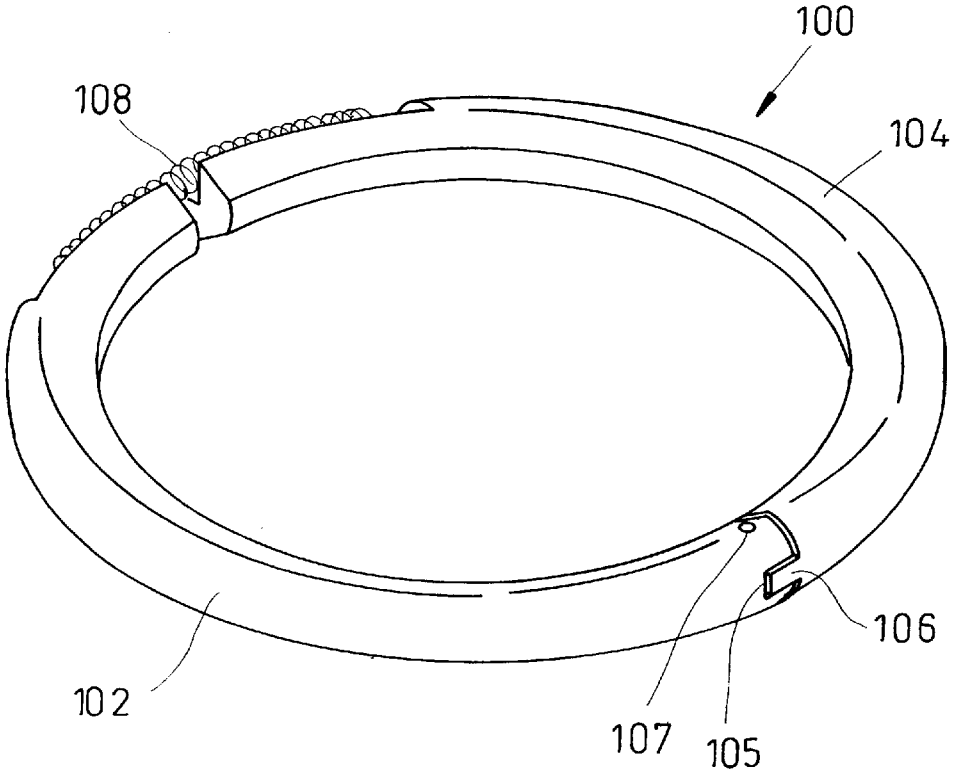
FIG. 20 shows still another embodiment of the retainer ring of the present invention.

FIG. 20 shows still another embodiment of the retainer ring 100 of the present invention. The retainer ring 100 also has two ring bodies 102, 104. Two opposite ends of the two ring bodies are connected by means of a mortise section 105 and a tenon section 106 inserted therein. An insertion pin 107 is passed through the mortise section 105 and tenon section 106 to form a pivot end. The other two opposite ends of the ring bodies are connected by a resilient member 108 as in FIG. 16. Accordingly, the retainer ring can be resiliently stretched to stop and hold a screwed member.

According to the above arrangement, when operated, the wrench of the present invention not only is able to stop the screwed member from slipping out, but also is able to hold the screwed member.

What is claimed is:

1. Wrench comprising at least one box end, a head section of the box end being formed with a polygonal socket having multiple teeth on an inner circumference for engaging with a polygonal screwed member, said wrench further comprising:

an annular groove formed in the head section; and a retainer ring mounted in the annular groove, the retainer ring being resiliently stretchable, an inner edge of the retainer ring protruding into the socket, whereby at a normal state, a gap is defined between the retainer ring and an inner circumference of the annular groove, thereby permitting the retainer ring to resiliently stretch outward, the retainer ring forming a stopper section in the head section, wherein the retainer ring includes at least two arched ring bodies having two opposite ends adjoined with each other to form a circular configuration, and at least two resilient members each connected with the opposite ends of the adjacent ring bodies.

2. Wrench as claimed in claim 1, wherein the retainer ring is formed with a split.

3. Wrench as claimed in claim 2, wherein an inner side of the bottom of the retainer ring is formed with a lower slope.

4. Wrench as claimed in claim 1, wherein two ends of each ring body are respectively formed with two recesses, the resilient members being respectively disposed in the recesses of the opposite ends of the adjacent ring bodies.

5. Wrench as claimed in claim 1, wherein the annular groove is formed in the socket.

6. Wrench as claimed in claim 1, wherein an inner side of the bottom of the retainer ring is formed with a lower slope.

7. Wrench as claimed in claim 1, wherein an inner side of the top of the retainer ring is formed with an upper slope.

8. Wrench as claimed in claim 2, wherein an inner side of the top of the retainer ring is formed with an upper slope.

9. Wrench comprising at least one box end, a head section of the box end being formed with a polygonal socket having multiple teeth on an inner circumference for engaging with a polygonal screwed member, said wrench further comprising:

an annular groove formed in the head section; and a retainer ring mounted in the annular groove, the retainer ring being resiliently stretchable, an inner edge of the retainer ring protruding into the socket, whereby at a normal state, a gap is defined between the retainer ring and an inner circumference of the annular groove, thereby permitting the retainer ring to resiliently stretch outward, the retainer ring forming a stopper section in the head section;

wherein the retainer ring includes two semicircular ring bodies which are oppositely adjoined with each other to form a circular configuration, two opposite ends of the ring bodies being pivotally connected, and a resilient member being connected with the other two opposite ends of the ring bodies.

10. Wrench as claimed in claim 9, wherein an inner side of the bottom of the retainer ring is formed with a lower slope.

11. Wrench as claimed in claim 9, wherein an inner side of the top of the retainer ring is formed with an upper slope.

12. Wrench comprising at least one box end, a head section of the box end being formed with a polygonal socket having multiple teeth on an inner circumference for engaging with a polygonal screwed member, said wrench further comprising:

an annular groove formed in the head section; and a retainer ring mounted in the annular groove, the retainer ring being resiliently stretchable, an inner edge of the retainer ring protruding into the socket, whereby at a normal state, a gap is defined between the retainer ring and an inner circumference of the annular groove, thereby permitting the retainer ring to resiliently stretch outward, the retainer ring forming a stopper section in the head section;

wherein a wall free from any tooth is formed between the top of the teeth and the top of the head section, the wall defining an inner hole communicating with the socket, the annular groove being formed with the inner hole.

* * * * *